US005248030A

United States Patent [19]

Tarozzi

[11] Patent Number: 5,248,030

[45] Date of Patent: Sep. 28, 1993

[54] FOLDING INSTRUMENT CONTAINER

[75] Inventor: Richard A. Tarozzi, Gales Ferry, Conn.

[73] Assignee: Binney & Smith Inc., Easton, Pa.

[21] Appl. No.: 989,897

[22] Filed: Dec. 10, 1992

Related U.S. Application Data

[63] Continuation of Ser. No. 786,389, Nov. 1, 1991, abandoned.

[51] Int. Cl.[5] ..... B05C 17/00; B65D 85/28

[52] U.S. Cl. ..... 206/1.7; 206/379; 206/443; 206/45.23; 206/45.2; 206/214

[58] Field of Search ..... 206/1.7, 443, 214, 224, 206/45.2, 45.15, 45.23, 45.18, 379, 472, 1.8, 1.9

[56] References Cited

U.S. PATENT DOCUMENTS

| | | | |
|---|---|---|---|
| D. 277,195 | 1/1985 | Lahmer | D1975/75 X |
| D. 315,446 | 3/1991 | Dietterich et al. | D3/74 |
| D. 316,934 | 5/1991 | Stanfield | D3/74 X |
| 565,710 | 8/1896 | Tollner | 206/214 |
| 870,771 | 11/1907 | Garman | 206/1.7 X |
| 873,421 | 12/1907 | Fleming | 211/69.9 |
| 1,054,487 | 2/1913 | Bagley | 206/45.18 |
| 1,130,811 | 3/1915 | Goldsmith | 206/371 X |
| 1,687,136 | 10/1928 | Myers | 211/69.9 |
| 1,911,799 | 5/1933 | Buchan | 248/447 |
| 1,957,039 | 5/1934 | Buenger et al. | 281/33 |
| 2,228,493 | 1/1941 | Will | 206/214 |
| 3,195,925 | 7/1965 | Walker, Jr. | 281/33 |
| 4,380,293 | 4/1983 | Wilcox et al. | 206/214 X |
| 4,475,650 | 10/1984 | DeFazio, Jr. | 206/224 X |
| 4,573,569 | 3/1986 | Parker | 206/45.2 |
| 4,616,851 | 10/1986 | Mann | 281/43 |
| 4,648,505 | 3/1987 | Belmondo | 206/214 |
| 4,793,633 | 12/1988 | Rose, Jr. | 206/472 |
| 4,815,622 | 3/1989 | Cramer | 206/443 |
| 4,875,707 | 10/1989 | Krom | 206/214 |
| 4,893,711 | 1/1990 | Gustafson | 206/45.24 |

FOREIGN PATENT DOCUMENTS

| | | | |
|---|---|---|---|
| 1265215 | 5/1961 | France | 206/443 |

*Primary Examiner*—William I. Price

*Attorney, Agent, or Firm*—Leydig, Voit & Mayer

[57] ABSTRACT

An instrument container comprising a carrying case having at least two storage sections for retaining instruments joined by at least one hinge so that said storage sections can be folded apart about at least one said hinge to open said case, a sleeve including a recess within which said carrying case fits when said carrying case is in the closed position, preferably pivot means joining said sleeve to said carrying case for permitting said case to be pivotally inserted into said recess when said case is closed, and preferably support means in said sleeve for supporting said storage sections of said case when said case is opened outside said sleeve.

48 Claims, 4 Drawing Sheets

FOLDING INSTRUMENT CONTAINER

This is a continuation of copending application Ser. No. 07/786,389 filed on Nov. 1, 1991 and now abandoned.

FIELD OF THE INVENTION

This invention relates to a portable carrying case for writing, drawing or painting instruments or the like. When the instrument container assembly is closed, the instruments can be easily transported. When it is open, it allows full visual inspection of, and ready access to, all of the instruments.

BACKGROUND OF THE INVENTION

Artists generally require a wide assortment of pens, pencils, brushes, knives, and other drawing, writing, painting, and carving instruments, each instrument meeting a specific need. Children also use various writing, drawing and artistic instruments for school work and extracurricular activities.

Artists, especially child artists, having a myriad of supplies, can be frustrated by the task of arranging and storing each instrument. Such instruments are also commonly lost or temporarily misplaced. While various pencil boxes and writing and drawing instrument container assemblies have been devised, they often are cumbersome to carry and unwieldy. Typically, these containers are poorly organized. Often, the instruments are stored together in an undivided box or tray.

An artist or child having many writing, painting or drawing instruments generally cannot easily see and select a desired instrument in an undivided box. As instruments such as pencils and crayons are used, they become smaller and thus more and more difficult to retrieve from the box, making searching for a particular instrument in a box full of instruments a frustrating task. Fragile or delicate instruments may be broken. Furthermore, storing different instruments in an undivided or unorganized box may be messy if uncapped pens, pencils and wet brushes are placed in the box.

In addition, many containers for artists' instruments have been made of such materials as wood, cardboard or metal. Durable containers that can withstand the rigors of being carried by an artist or a child for long periods of time are not generally available. Such containers must be appropriate for different environments, able to withstand the impact of being dropped and other types of abuse, and sufficiently sturdy to withstand opening and closing many times. Often, such containers break after being subjected to regular use for a short time, resulting in scattered, lost or broken instruments.

OBJECTS OF THE INVENTION

It is therefore an object of the invention to provide an instrument container for writing, drawing or painting instruments having a carrying handle which can be easily grasped.

A further object of the invention is to provide an instrument container assembly of a convenient size and shape to allow easy transport.

Another object of the invention is to provide a secure and durable instrument container assembly for the transport of various types of writing, drawing and painting instruments which will maintain each instrument in a clean and usable condition.

A further object of the invention is to provide a instrument container assembly that secures each instrument in a separate receptacle to said in organization and transport of the instruments.

Another object of the invention is to provide an instrument container assembly which may also operate as a display case allowing full visual inspection of all instruments contained within the container while the container is in the open display position as well as allowing easy access to all the instruments contained within the instrument container assembly.

SUMMARY OF THE INVENTION

These and other goals are achieved by the present instrument container assembly, which comprises a portable carrying case and a support sleeve preferably connected to the portable carrying case by pivot means.

The portable carrying case preferably includes at least two storage sections, preferably substantially identical, each storage section having a carrying handle at its top edge. The storage sections are hingedly fastened to an adjacent common binder member in a manner permitting relative angular displacement of the storage sections about the binder member for opening and closing the portable carrying case. The facing walls of the storage sections include a plurality of vertical recessions for holding instruments, such as pens and pencils, in a secure fashion.

The support sleeve operates to embrace the portable carrying case and hinder the angular displacement of each storage section when the portable carrying case is in the closed position. The support sleeve includes two opposing side walls being at least partially closed at the bound edge and an edge opposite the handle edge of the portable carrying case which, preferably, is wholly or partly closed. The remaining two edges of the opposing side walls are open, forming a mouth.

The pivot means connecting the portable carrying case to the support sleeve enables the portable carrying case to be rotated out of the support sleeve and into a position where the support sleeve does not inhibit the angular displacement of each storage section about the binder member.

The instrument container assembly of the present invention may also have a means for locking and securing the portable carrying case for transport within the support sleeve as well as a means for guiding the portable carrying case into the support sleeve. The means for guiding the portable carrying case may also be constructed in a manner allowing it to operate as a means for maintaining the portable carrying case in the open position. The support sleeve may also be constructed to offer support to the portable carrying case when in the open position.

DETAILED DESCRIPTION OF THE PREFERRED EMBODIMENT

Figure 1:
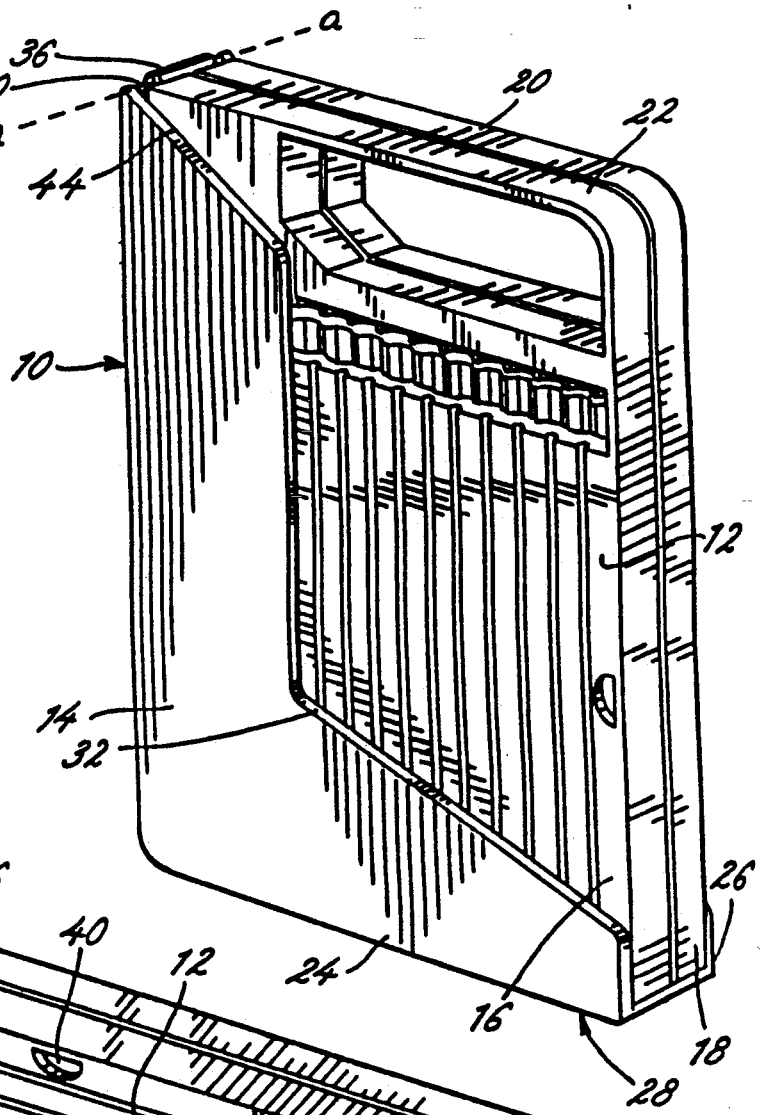
FIG. 1 is a perspective view of the preferred embodiment of an instrument container assembly when closed and erect.

The sectional container of the present invention is especially suited for holding a plurality of elongated, generally cylindrical instruments such as crayons, pencils, pens, painting brushes, knives, drill bits, or the like in parallel, ordered relation. The interior shape of the container can, however, be formed differently to accommodate other types of instruments. Without limiting the scope of the invention, the invention will be described in terms of a sectional container shaped like a book which is used for holding a plurality of writing, drawing and painting instruments.

Referring now to the drawings, wherein like reference numerals designate identical or corresponding parts throughout the several views, the figures show one embodiment of an instrument container assembly 10 having a portable carrying case 12 and a support sleeve 14.

In FIG. 1 the instrument container assembly 10 is shown in its closed, upright and ready to carry position. The portable carrying case 12 is closed and the support sleeve 14 embraces the portable carrying case 12 in a manner so as to hinder the angular displacement of storage sections 16 and 18 from the closed position. Each of the storage sections 16 and 18 has a longitudinally disposed carrying handle 20 and 22 at one end. The carrying handles 20 and 22 allow the instrument container assembly 10 and its contents to be easily transported.

The preferred embodiment of the support sleeve 14 has two similarly shaped opposing side walls 24 and 26, an open handle edge 32, a closed bound edge 30, and a closed edge 28. These edges form a recess having a mouth 34, shown in FIG. 3, into which the carrying case 12 fits. This design allows the portable carrying case 12 to rotate in and out of the support sleeve 14 for display. The open handle edges 32 of the opposing side walls 24 and 26 are constructed with an angled sleeve rim 44 which slopes from the corner of the support sleeve formed by the sleeve binder edge 30 and the sleeve handle edge 32, back toward the sleeve closed edge 28. The angled sleeve rims 44 offer support to the portable carrying case 12 when the portable carrying case 12 is in the open position and can be constructed with any desirable angle to meet the needs of the standard user in a specific capacity. The portable carrying case 12 preferably is attached to the support sleeve 14 by pivot means 36, preferably a hinge assembly, which allows the portable carrying case 12 to rotate out of the support sleeve 14 around the a—a axis in FIG. 1.

Figure 2:
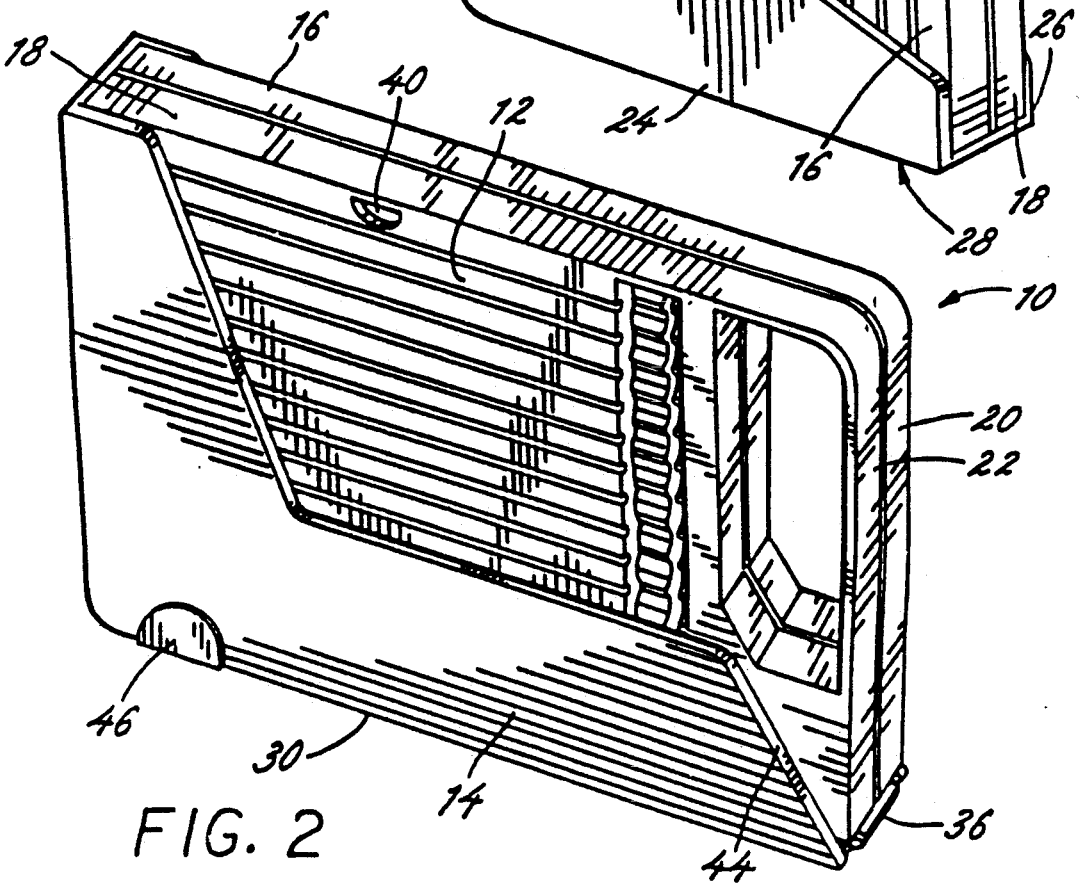
FIG. 2 is a perspective view of the assembly of FIG. 1 resting on its spine.
Figure 3:
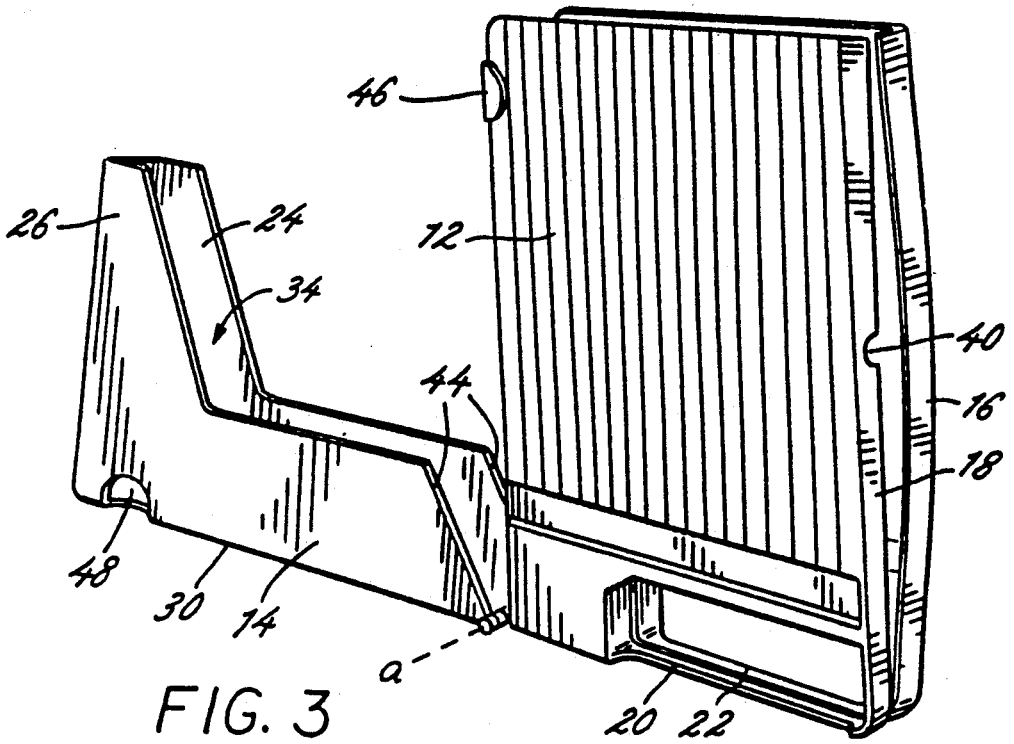
FIG. 3 is a perspective view of the assembly of FIG. 1 after its case is withdrawn from its supporting sleeve.
Figure 4:
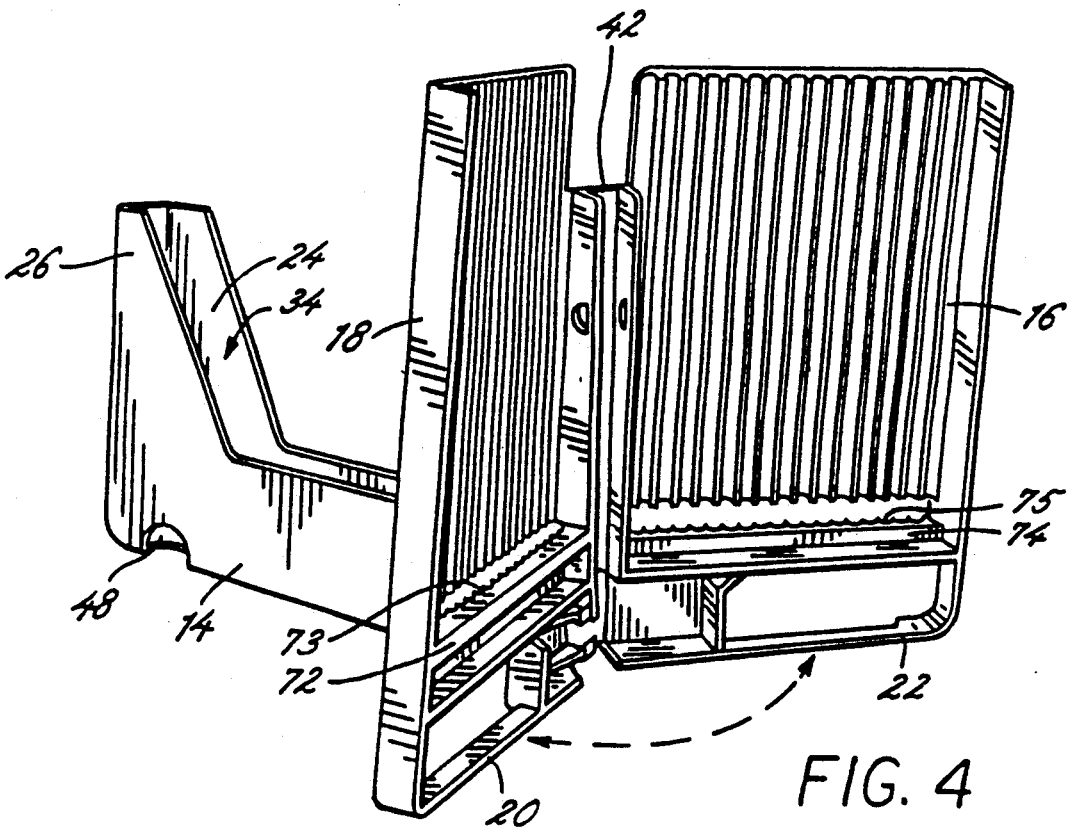
FIG. 4 is a perspective view of the assembly of FIG. 1 after its case is opened.
Figure 5:
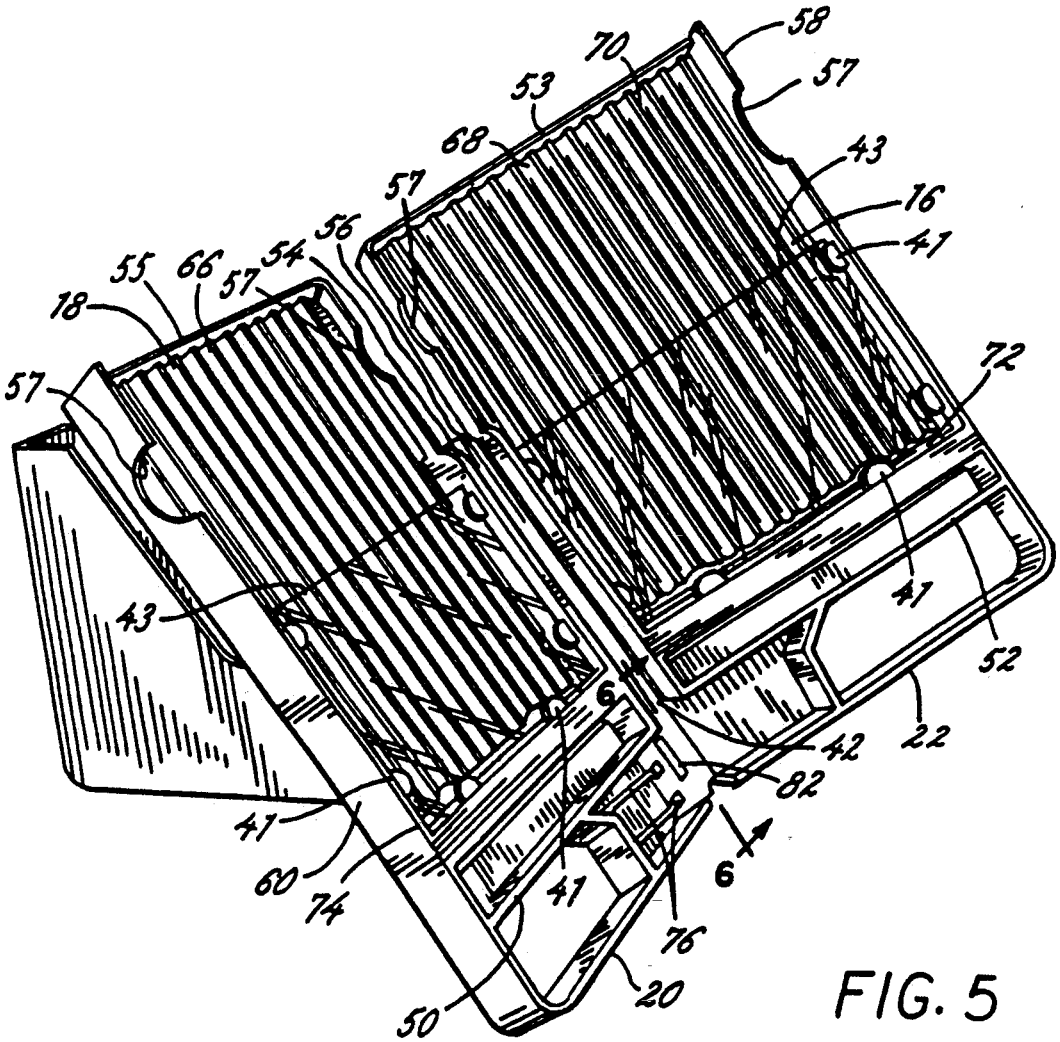
FIG. 5 is a perspective view of the assembly of FIG. 1 after its case is opened and propped up in the viewing position.

FIGS. 2-5 show the preferred embodiment of the instrument container assembly 10 in a succession of views progressing from the closed position in FIG. 2 to the open position in FIG. 5. In FIG. 2 the instrument container assembly 10 is shown in the closed position with the instrument container resting on the supporting sleeve closed binder edge 30.

FIG. 3 illustrates the portable carrying case 12 during rotation out of the support sleeve 14 and into a position where the angular displacement of the storage sections 16 and 18 of the portable carrying case 12 are not hindered by the opposing side walls 24 and 26 of the support sleeve 14. As the portable carrying case 12 is rotated out of the support sleeve 14, the portable carrying case 12 comes to rest on the longitudinally disposed carrying handles 20 and 22 in a raised instrument viewing position. Finger recesses 40 may be provided near the unbound edge of each storage section 16 and 18 to allow for easier grasping of the portable carrying case 12 for rotation out of the support sleeve 14.

There may be a locking projection 46 on the outer surface of one of the storage sections 18. This locking projection 46 engages a side wall recession 48 of complementary shape in the opposing side wall 26 of the support sleeve 14. The locking projection 46 and complimentary recess 48 are preferably semicircular in shape. Together, the locking projection 46 and the sleeve wall recession 48 provide a releasable frictional lock holding the portable carrying case 12 securely within the support sleeve 14 when the instrument container assembly 10 is in the closed carrying position as in FIG. 1.

The locking projection 46 should protrude sufficiently from the outer surface of the storage section 16 so that unless the locking projection 46 is actually matably engaged with the complimentarily shaped sleeve wall recession 48 in the side wall 24 of the support sleeve 14, storage sections 16 and 18 will not be properly joined.

When the locking projection 46 and the sleeve wall recession 48 mate, the portable carrying case 12 fits comfortably within the support sleeve 14. When the locking projection 46 and the sleeve wall recession 48 are properly engaged, the portable carrying case 12 is between the opposing side walls 24 and 26 of the support sleeve 14 in the closed position, and the locking projection 46 must be pushed inward and out of the sleeve wall recession 48 to allow rotation of the portable carrying case 12 out of the support sleeve 14.

Figure 8:
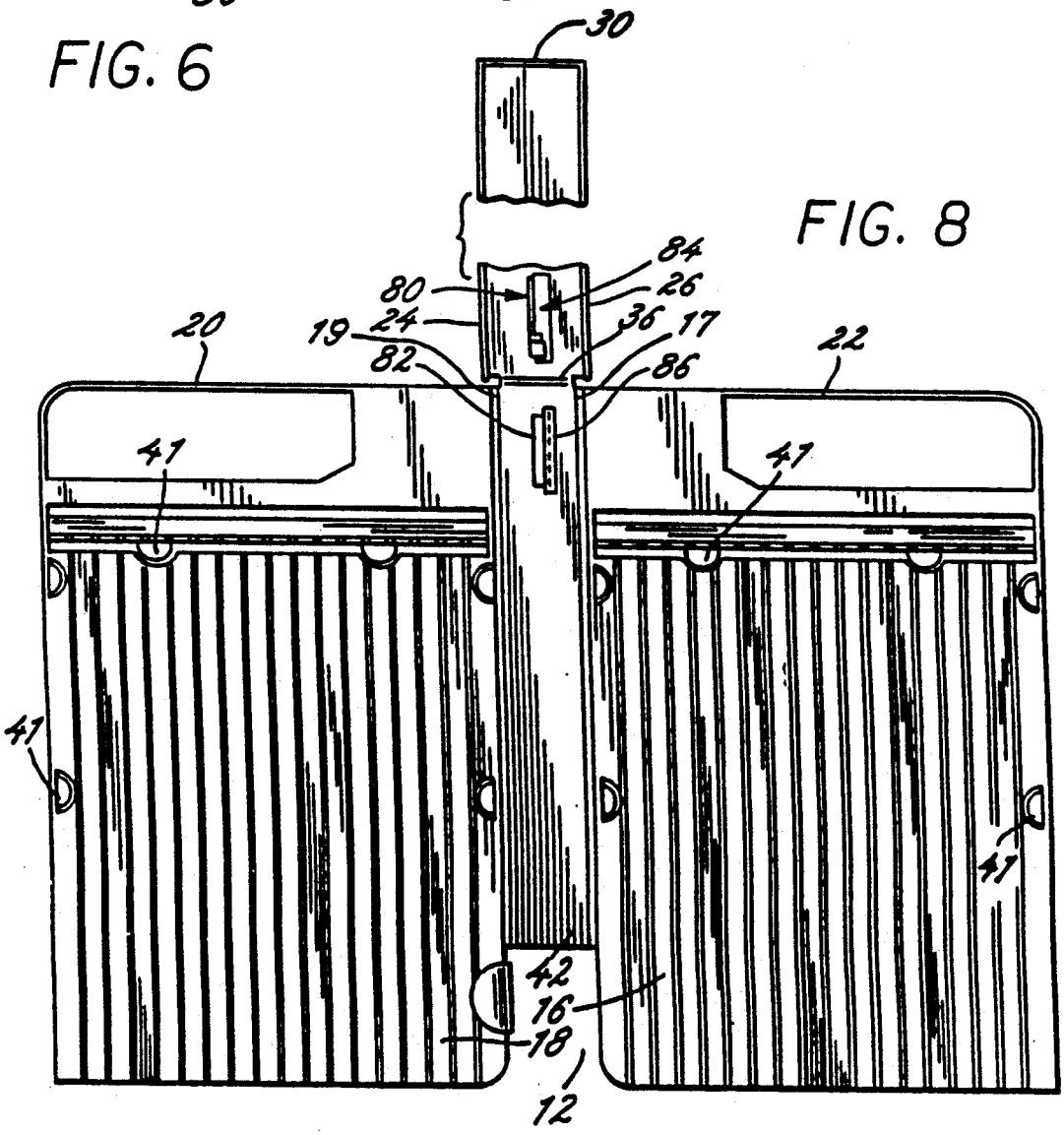
FIG. 8 is a plan view of the assembly of FIG. 1 with its case fully open and unfolded to a prone position.

FIG. 4 illustrates the rotation of the storage sections 16 and 18 about the portable carrying ca e binder member 42 into an open position in which the instruments within the portable carrying case 12 can be viewed. Storage sections 16 and 18 may be connected by a hinge. However, it is preferred that storage sections 16 and 18 be connected by hinge means 17 and 19 to the opposite edges of a case binder member 42, as shown in FIG. 8. Hinge means 17 and 19 are constructed in such a way that each storage section 16 and 18 will rotate through at least 90 degrees relative to the case binder member 42. Thus, when portable carrying case 12 is fully opened, storage sections 16 and 18 are substantially parallel to each other, as shown in FIG. 5. This allows full visual inspection of all stored instruments while the instruments remain held in their stored positions. Although two storage sections are preferred in the present invention, additional storage sections may also be incorporated in carrying case 12. Additional storage sections can be hingedly attached in series to storage sections 16 and 18.

FIG. 5 shows the instrument container assembly 10 in its fully opened and supported position. Once the portable carrying case 12 is opened with the storage sections 16 and 18 substantially parallel to each other, the portable carrying case 12 can be tilted back along pivot means 36 onto the angled sleeve rims 44 of the sleeve open handle edges 32. The angled sleeve rims 44 offer support to the tilted portable carrying case 12 allowing the most comfortable visual inspection of all the stored instruments.

FIG. 5 also provides a view of the inner surface and cavity construction of the preferred embodiment of the storage sections 16 and 18. The storage sections 16 and 18 have case walls 66 and 68. Handle edges 50 and 52 of carrying handles 20 and 22 act to effectively close those edges of the storage sections 16 and 18. Handle edges 50 and 52 also act to vertically support instruments stored in carrying case 12. Storage sections 16 and 18 also have closed bound edges 54 and 56, and closed unbound edges 58 and 60. The edges of storage sections 16 and 18 opposite handle edges 50 and 52 may be open, but preferably have ridges 53 and 55 running from closed unbound edges 58 and 60 to closed bound edges 54 and 56, respectively, for further securing instruments in storage sections 16 and 18. Ridges 53 and 55 are oriented perpendicular to case walls 66 and 68 and are of such a size that ridges 53 and 55 do not contact each other when carrying case 12 is in the closed position. Ridges 53 and 55 and closed unbound edges 58 and 60 also preferably contain cut-outs 57, as shown in FIG. 5. Cut-outs 57, which are preferably semi-circular in shape, are located so that when carrying case 12 is in the closed position, cut-out 57 in unbound edge 58 meets cut-out 57 in unbound edge 56, and cut-out 57 in ridge 53 meets cut-out 57 in ridge 55 to form access holes. These access holes allow carrying case 12 to be more easily opened.

The preferred embodiment of the invention shown in FIG. 5 provides a plurality of substantially U-shaped vertical recessions 70 on the inner surfaces of the storage section walls 66 and 68 for receiving such instruments as pencils, pens, paint brushes, crayons, or other similar writing instruments. Because many writing instrument producers follow similar size, shape, length and diameter standards in the products they market, the recessions 70 on the storage section walls 66 and 68 are constructed with a shape that hugs a standard sized writing instrument.

Along the inner surface of the storage section walls 66 and 68 are storage section securing members 72 and 74 which run from the storage section closed bound edges 54 and 56 to the storage section closed unbound edges 58 and 60 of storage sections 16 and 18, respectively. These securing members 72 and 74 are constructed without protrusions out of their respective storage section cavities that might inhibit the closing of the storage sections 16 and 18. Securing members 72 and 74 may be connected to handle edges 50 and 52, and/or case walls 66 and 68 by one or more stiffening ribs for added strength.

The securing members 72 and 74, which preferably are made of semi-rigid plastic, have one side, the inner side, flush with the edges of the cavity that make contact with the respective securing member 72 and 74. The other side of securing members 72 and 74 have complementary U-shaped vertical recessions 73 and 75 that mirror the U-shaped vertical recessions 70 of the storage section wall inner surfaces, as shown in FIG. 4. The securing members 72 and 74 are constructed with a thin profile and hence make little contact with the instruments stowed in the case section wall inner surfaces. This design allows for a reliable and effective securing system while at the same time providing for full visual inspection of all instruments whether the instruments be large or small. This design also allows easy removal of the stored instruments for use. Because of the thin profile of the securing members 72 and 74, even small and difficult to handle instruments may be secured and removed from the storage sections 16 and 18 easily.

The instruments may be further secured in storage sections 16 and 18 by projections 41 on closed unbound edges 58 and 60, and securing members 72 and 74, which are shown in FIG. 5. Projections 41, which are preferably shaped in the form of a half moon, are oriented parallel to case binder member 42. Projections 41 act to hold in place removable rectangular sheets 43 (shown in FIG. 5) which further horizontally support instruments in storage sections 16 and 18. Sheets 43 may also be templates.

FIG. 5 also shows two sharpener projections 76 and 78 on one of the inner surface of storage section 16 between the longitudinally disposed carrying handle 20 and the portable carrying case binder member 42. The sharpener projections 76 and 78 serve as an instrument sharpener holder. Just as writing, painting and drawing instruments are constructed with standardized dimensions, so are instrument sharpeners. The two sharpener projections 76 and 78 are designed around the dimensions of standard sharpener size and act in concert to grip a sharpener and hold the sharpener securely in position.

Figure 6:
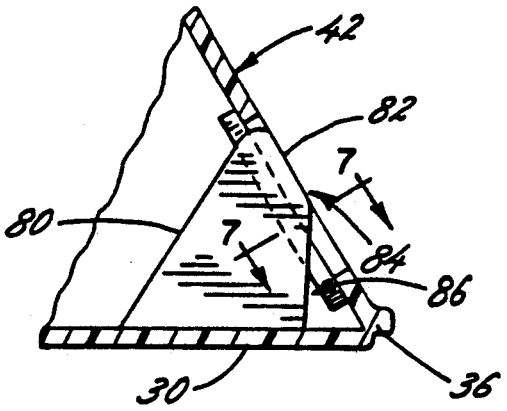
FIG. 6 is a sectional view taken along the line 6—6 of FIG. 5.

FIG. 6 shows a sectional view taken along the line 6—6 of FIG. 5. This view shows a support sleeve 80 which extends from the inner surface of the closed bound edge 30 of the support sleeve 14. Although the present invention contains the support sleeve projection 80, it is not necessary to practice the invention. If the support sleeve projection is used, it is preferably fin-like in shape. The support sleeve projection 80 extends between and parallel to the opposing side walls of the support sleeve 24 and 26, as can be more clearly seen in FIG. 8. This support sleeve projection 80 may operate in two different capacities. First, the support sleeve projection 80, in concert with the case binder member 42 having a case binder member opening 82, also shown in FIG. 8, operates to guide the portable carrying case 12 into the support sleeve 14 and into the closed position as seen in FIG. 1. As the case binder member 42 is rotated into the support sleeve 14, the support sleeve projection 80 enters bind®r member opening 82, thereby restraining the case binder member 42 to movement in a single plane toward the support sleeve closed bound edge 30 to minimize stress and fatigue on the pivot means 36.

Figure 7:
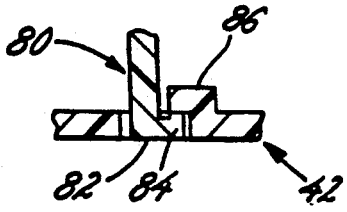
FIG. 7 is a sectional view taken along the line 7—7 of FIG. 6.

Second, the support sleeve projection 80 operates in concert with the case binder member opening 82 as a means for maintaining the portable carrying case in an open position. FIGS. 7 and 8 demonstrate the support sleeve projection 80 having a bevelled end 84 that mates with a case binder member opening receding edge 86 adjacent to case binder member opening 82 and hinders further rotation of the portable carrying case out of the support sleeve 14. The instrument container assembly 10 is preferably constructed of a semi-rigid plastic which allows support sleeve projection 80 to bend from its primary position allowing the portable carrying case 12 to actually be pulled off the bevelled end 84 of the support sleeve projection 80 and rotated into a position as in FIG. 3 for easy opening.

Once the portable carrying case 12 is in the open position, as in FIG. 4, the portable carrying case 12 can be tilted back on the angled sleeve rims 44 of the support sleeve 14 and hooked through the case binder member opening 82 by the bevelled end 84 of the projection 80. The semi-rigid plastic allows the bevelled end 84 and the case binder member opening receding edge 86 to temporarily bend until the bevelled end 84 is through the case binder member opening 82 and resting in the hooked position shown in FIG. 7. Once the bevelled end 84 and case binder member opening receding edge 86 are in the hooked position as in FIG. 7, the container assembly is in a secure viewing position.

The weight of the storage sections 16 and 18 holds the portable carrying case 12 open with the angled sleeve rims 44 acting as a fulcrum between the two storage sections 16 and 18. The angled sleeve rims 44 also act as a fulcrum between pivot means 36 and the weight of the storage sections 16 and 18

It is apparent that this description provides improved principles of design and construction with respect to instrument holding devices. In this connection, it is to be understood that various changes can be made in the general form and arrangement of the parts described without departing from the invention, and hence this description should not limit the invention to the precise details set forth in the specification, but should include all variations that are reasonably covered by the claims.

What is claimed is:

1. A portable apparatus comprising:

a. a carrying case having at least two storage sections joined by at least one hinge, each said storage section having an inner display surface containing means for retaining instruments, and an outer surface, wherein said storage sections can be folded apart on at least one said hinge to open said case and expose said display surfaces, and wherein said storage sections can be folded together on at least one said hinge to close said case;

b. a sleeve including a recess defined by facing, generally parallel side walls and a closed binder edge, said recess having a mouth, the side walls of said sleeve being spaced to admit said case through said mouth only when said case is closed and to prevent said case from being opened while said case is within said recess; and c. support means on said sleeve for supporting the said storage sections of said case at an angle between zero and 90 degrees with respect to a generally horizontal support surface when said case is opened outside said sleeve.

2. An apparatus comprising:

a. a carrying case having at least two storage sections joined by at least one hinge, each said storage section having an inner display surface containing means for retaining instruments, and an outer surface, wherein said storage sections can be folded apart on at least one said hinge to open said case and expose said display surfaces, and wherein said storage sections can be folded together on at least one said hinge to close said case;

b. a sleeve including a recess defined by facing, generally parallel side walls and a closed binder edge, said recess having a mouth, the side walls of said sleeve being spaced to admit said case through said mouth only when said case is closed and to prevent said case from being opened while said case is within said recess; and c. pivot means joining said binder edge of said sleeve to said case for permitting said case to be pivotally inserted into said recess when said case is closed.

3. An apparatus according to claim 2, further comprising support means on said sleeve for supporting the said storage sections of said case at an angle between zero and 90 degrees with respect to a generally horizontal support surface when said case is opened outside said sleeve.

4. An apparatus according to claim 3, wherein each of said storage sections comprises an upright wall having an edge which is effectively closed by a longitudinally disposed carrying handle.

5. An apparatus according to claim 3, further comprising a means for maintaining said portable carrying case in a closed and embraced position.

6. An apparatus according to claim 5, wherein said means for maintaining said portable carrying case in a closed and embraced position comprises one of said side walls of said support sleeve having a portion of said side wall removed to form a recess and one said outer surface of said storage sections having an outward locking projection of a raised shape complimentary to said support sleeve recess, said locking projection mating with said recess and forming a frictional lock.

7. An apparatus according to claim 3, further comprising a means for guiding said portable carrying case into said support sleeve.

8. An apparatus according to claim 7, wherein said means for guiding said portable carrying case into said support sleeve comprises said closed binder edge of said support sleeve having a projection extending between and parallel to the said side walls of said support sleeve from a position near said pivot means on said binder edge of said sleeve, said projection acting in concert with a case binder member joining said storage sections and having a portion of said case binder member removed to form a matable recess to guide said projection and said portable carrying case into the closed carrying position.

9. An apparatus according to claim 8, wherein said projection also acts as a means for engaging said portable carrying case in an open position.

10. An apparatus according to claim 9, wherein said projection has bevelled lip which engages said recess in said case binder member.

11. An apparatus according to claim 8, wherein said projection is fin-like in shape.

12. An apparatus according to claim 3, wherein said support means comprise said support sleeve having a portion of said side wall material removed, creating rims angling back from said pivot means.

13. An apparatus according to claim 3, wherein said means for retaining instruments includes on each of said inner surface of said storage sections a plurality of vertical recesses and a securing member running along the inner side of said storage section walls between the bound and unbound edges of each storage section wall.

14. An apparatus according to claim 3, further comprising a means for securing an instrument sharpener.

15. An apparatus according to claim 14, wherein said means for securing an instrument sharpener comprises two projections constructed so as to embrace said instrument sharpener, said projections being on said inner surface of one of said storage sections between said longitudinally disposed carrying handle and said hinge.

16. An apparatus according to claim 3, further comprising a means for maintaining said portable carrying case in a closed and embraced position, a means for guiding said portable carrying case into said supporting sleeve, a means for engaging said portable carrying case in an open position, a means for supporting said portable carrying case in an open display position, a means for retaining instruments within said portable carrying case, and a means for securing an instrument sharpener.

17. An apparatus comprising:

a. a portable carrying case having two substantially identical storage sections, each storage section having an upright case section wall, a longitudinally disposed carrying handle at its top edge when in the carrying position which effectively closes that edge, an open edge opposite the handle edge, a closed bound edge, and a closed unbound edge opposite the closed bound edge, each storage section opposing the other in such a manner that when closed the storage sections form a case with one open end, said storage sections being fastened at their respective closed bound edges to an adjacent case binder member in a manner permitting relative angular displacement of said storage sections about said case binder member for opening and closing said portable carrying case;

b. a support sleeve for embracing said portable carrying case and hindering the angular displacement of said storage sections when the portable carrying case is in the closed position, said support sleeve having two oppositely facing side wall being closed at the binder edge and at the edge opposite the handle edge of the portable carrying case, and open at the handle edge; and c. a hinge connecting said support sleeve to said portable carrying case so as to enable said portable carrying case to be rotated out of the support sleeve and into a position where the support sleeve does not inhibit the angular displacement of said storage sections.

18. An apparatus according to claim 17, further comprising a means for maintaining said portable carrying case in a closed and embraced position, a means for guiding said portable carrying case into said supporting sleeve, a means for engaging said portable carrying case in an open position, a means for supporting said portable carrying case in an open display position, a means for retaining instruments within said portable carrying case, and a means for securing an instrument sharpener.

19. An apparatus according to claim 18, further comprising a means for maintaining said portable carrying case in a closed and embraced position, said means comprising one of said two side walls of said support sleeve having a portion of said wall removed to form a recess and one the outer surfaces of said storage sections having an outward locking projection of a raised shape complimentary to said support sleeve recess, said locking projection mating with said recess and forming a frictional lock, a means for guiding said portable carrying case into said support sleeve with said binder edge of the support sleeve having a fin-like projection extending between and parallel to said side walls of said support sleeve, said fin-like projection acting in concert with said case binder member having a portion of said portable carrying case binder member removed to form a matable recess to guide said fin-like projection and said portable carrying case into the closed carrying position, a means for engaging said portable carrying case in an open position in which said fin-like projection comprises a bevelled lip which engages said recess in said case binder member, a means for support of said portable carrying case in an open position comprising said support sleeve having a portion of said side wall material removed creating rims angling back toward the edge opposite the handle edge of the support sleeve, said angled rims providing support for the portable carrying case when the portable carrying case is in the open display position, a means for retaining instruments within said portable carrying case including on each of the storage sections a plurality of U-shaped vertical recesses and a securing member running along the bottom of the inner side of each said storage section wall between the bound and unbound edges of each said storage section wall, and a means for securing an instrument sharpener comprising two projections constructed so as to embrace the said instrument sharpener, said projections being on the inner surface of one of said storage sections between said longitudinally disposed carrying handle and said case binder member.

20. An apparatus according to claim 1 wherein each of said storage sections comprises an upright wall having an edge which is effectively closed by a longitudinally disposed carrying handle.

21. An apparatus according to claim 1, further comprising a means for maintaining said portable carry case in a closed and embraced position.

22. An apparatus according to claim 21, wherein said means for maintaining said carrying case in a closed and embraced position comprises one of said side walls of said support sleeve having a portion of said side wall removed to form a recess and one said outer surface of said storage sections having an outward locking projection of a raised shape complementary to said support sleeve recess, said locking projecting mating with said recess and forming a frictional lock.

23. An apparatus according to claim 1, further comprising a means for guiding said portable carrying case into said support sleeve.

24. An apparatus according to claim 23, wherein said means for guiding said potable carrying case into said support sleeve comprises said closed binder edge of said support sleeve having a projection extending between and parallel to the said side walls of said support sleeve from a position on said binder edge of said sleeve, said projection acting in concert with a case binder member joining said storage sections and having a portion of said case binder member removed to form a matable recess to guide said projection and said portable carrying case into the closed carrying position.

25. An apparatus according to claim 24, wherein said projection also acts as a mean for engaging said portable carrying case in an open position.

26. An apparatus according to claim 25, wherein said projection has a bevelled lip which engages said recess in said case binder member.

27. An apparatus according to claim 24, wherein said projection is fin-like in shape.

28. An apparatus according to claim 1, wherein said support means comprise said support sleeve having a portion of said side wall material removed, creating rims angling back from said pivot means.

29. An apparatus according to claim 1, wherein said means for retaining instruments includes on each of said inner surface of said storage sections a plurality of vertical recesses and a securing member running along the inner side of said storage section walls between the bound and unbound edges of each storage section wall.

30. An apparatus according to claim 1, further comprising a means for securing an instrument sharpener.

31. An apparatus according to claim 30, wherein said means for securing an instrument sharpener comprises two projections constructed so as to embrace said instrument sharpener, said projections being on said inner secure of one of said storage sections between said longitudinally disposed carrying handle and said hinge.

32. An apparatus according to claim 1, further comprising means for securing a sheet to said storage section.

33. An apparatus according to claim 32, wherein said sheet is a template.

34. An apparatus according to claim 2 wherein each of said storage sections comprises an upright wall having an edge which is effectively closed by a longitudinally disposed carrying handle.

35. An apparatus according to claim 2, further comprising a means for maintaining said portable carrying case in a closed and embraced position.

36. An apparatus according to claim 35, wherein said means for maintaining said carrying case in a closed and embraced position comprises one of said side walls of said support sleeve having a portion of said side wall removed to form a recess and one said outer surface of said storage sections having an outward locking projection of a raised shape complementary to said support sleeve recess, said locking projecting mating with said recess and forming a frictional lock.

37. An apparatus according to claim 2, further comprising a means for guiding said portable carrying case into said sleeve.

38. An apparatus according to claim 37, wherein said means for guiding said potable carrying case into said sleeve comprises said closed binder edge of said sleeve having a projection extending between and parallel to the said side walls of said sleeve from a position near said pivot means on said binder edge of said sleeve, said projection acting in concert with a case binder member joining said storage sections and having a portion of said case binder member removed to form a matable recess to guide said projection and said portable carrying case into the closed carrying position.

39. An apparatus according to claim 38, wherein said projection also acts as a means for engaging said portable carrying case in an open position.

40. An apparatus according to claim 39, wherein said projection has a bevelled lip which engages said recess in said case binder member.

41. An apparatus according to claim 38, wherein said projection is fin-like in shape.

42. An apparatus according to claim 2, wherein said means for retaining instruments includes on each of said inner surface of said storage sections a plurality of vertical recesses and a securing member running along the inner side of said storage section walls between the bound and unbound edges of each storage section wall.

43. An apparatus according to claim 2, further comprising a means for securing an instrument sharpener.

44. An apparatus according to claim 43, wherein said means for securing an instrument sharpener comprises two projections constructed so as to embrace said instrument sharpener, said projections being on said inner surface of one of said storage sections between said longitudinally disposed carrying handle and said hinge.

45. An apparatus according to claim 2, further comprising means for securing a sheet to said storage section.

46. An apparatus according to claim 45, wherein said sheet is a template.

47. An apparatus according to claim 3, further comprising means for securing a sheet to said storage section.

48. An apparatus according to claim 47, wherein said sheet is a template.

* * * * *

UNITED STATES PATENT AND TRADEMARK OFFICE

CERTIFICATE OF CORRECTION

PATENT NO. : 5,248,030

DATED : September 28, 1993

INVENTOR(S) : Richard A. Tarozzi

It is certified that error appears in the above-indentified patent and that said Letters Patent is hereby corrected as shown below:

Col. 2, line 3, delete "said" and substitute therefor --aid--

Col. 4, line 41, delete "ca e" and substitute therefor --case--

Col. 6, line 43, delete "bind®r" and substitute therefor --binder--

In the Claims:

Col. 9, line 24, delete "wall" and substitute therefor --walls--

Col. 10, line 29, delete "projecting" and substitute therefor --projection--

Col. 10, line 46, delete "mean" and substitute therefor --means--

Col. 11, line 1, delete "secure" and substitute therefor --surface--

Col. 11, line 28, delete "potable" and substitute therefor --portable--

Signed and Sealed this

Fifth Day of April, 1994

Bruce Lehman

*Attest:*

BRUCE LEHMAN

*Attesting Officer*

*Commissioner of Patents and Trademarks*